US007503604B2

(12) United States Patent
Raeder et al.

(10) Patent No.: US 7,503,604 B2
(45) Date of Patent: Mar. 17, 2009

(54) CHOPSTICKS

(75) Inventors: Niels Raeder, Munich (DE); Oliver Berger, Munich (DE)

(73) Assignee: Fortune Products Holding AG, Zug (CH)

( * ) Notice: Subject to any disclaimer, the term of this patent is extended or adjusted under 35 U.S.C. 154(b) by 113 days.

(21) Appl. No.: 10/548,453

(22) PCT Filed: Feb. 12, 2004

(86) PCT No.: PCT/DE2004/000254

§ 371 (c)(1),
(2), (4) Date: Sep. 12, 2005

(87) PCT Pub. No.: WO2004/080250

PCT Pub. Date: Sep. 23, 2004

(65) Prior Publication Data

US 2006/0170229 A1 Aug. 3, 2006

(30) Foreign Application Priority Data

Mar. 12, 2003 (DE) ..... 103 11 179

(51) Int. Cl.
*A47G 21/10* (2006.01)

(52) U.S. Cl. ..... 294/1.1; 294/5.5; 30/125

(58) Field of Classification Search ..... 294/1.1, 294/5.5, 99.2; 30/125, 322, 324
See application file for complete search history.

(56) References Cited

U.S. PATENT DOCUMENTS 4,659,128 A * 4/1987 Dong ..... 294/99.2
5,056,841 A 10/1991 Yong

FOREIGN PATENT DOCUMENTS

| | | | |
|---|---|---|---|
| DE | 37 33 937 | A1 | 4/1989 |
| GB | 1 101 429 | | 1/1968 |
| GB | 2 089 198 | A | 6/1982 |
| JP | 0 925 2911 | A | 9/1997 |
| JP | 1119 6996 | A | 7/1999 |
| JP | 2000-201792 | * | 7/2000 |
| JP | 2000 333811 | A | 12/2000 |
| JP | 2002-113945 | * | 4/2002 |
| JP | 2002-306303 | * | 10/2002 |

* cited by examiner

*Primary Examiner*—Dean J Kramer
(74) *Attorney, Agent, or Firm*—Jacobson Holman PLLC

(57) ABSTRACT

A set of chopsticks having a main body with a cavity therein that, starting from the side opposite a mouthpiece of the chopsticks extends in the longitudinal direction into the chopsticks. An object, particularly an information carrier, is placed inside the cavity. The open end of the cavity is preferably closed by a stopper.

12 Claims, 1 Drawing Sheet

CHOPSTICKS

This is a nationalization of PCT/DE04/000254 filed Feb. 12, 2004 and published in German.

BACKGROUND OF THE INVENTION

1. Field of the Invention

The present invention relates to chopsticks.

2. Description of the Related Art

Chopsticks are predominantly used among the population of Asian countries for eating purposes. According to the tradition of these countries, chopsticks are used in place of a fork and serve the purpose of holding solid food, such as rice, meat, fish, noodles, etc. The practice of using chopsticks also has an increasing number of followers in other continents and countries. Each set of chopsticks are held in a hand in a certain manner and their movements are coordinated with one another such that even the smallest food particle can be held and taken to the mouth effortlessly.

For example, the patent applications DE 37 33 937 A1 describes chopsticks that taper conically and are provided with unevennesses at their end, which serves as a mouthpiece. Chopsticks of such type aim to prevent the gripped food particles from slipping off from the mouthpieces when the chopsticks are manipulated.

SUMMARY OF THE INVENTION

The objective of the present invention is to design chopsticks in such a manner that they find greater acceptance, particularly in non-Asian countries than is the case so far.

This objective is achieved by a chopstick having a main body with a blind bore extending longitudinally from an end opposite the mouthpiece into the chopstick main body to define a cavity that has an object placed therein. The object can be an information carrier or a figure, a photograph or a sweet. The cavity is closed on the end opposite the mouthpiece by a fixed stopper so that the object is hidden from view and inaccessible without breaking the chopstick.

The essential advantage is that the chopsticks according to the present invention have an information carrier in a cavity, preferably a rolled-up note of paper or the like, which is printed with information, for example in the form of a funny saying related to the topic of food, an amusing advertising slogan, etc. or a horoscope. The information carrier is released automatically and/or an access to the information carrier is made possible by breaking the chopsticks after the meal. This feature arouses the interest of people to eat using chopsticks.

Advantageous embodiments of the present invention are specified in the dependent claims.

BRIEF DESCRIPTION OF THE DRAWINGS

In the following description, the invention and its embodiments are explained more elaborately on the basis of the drawing of which.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
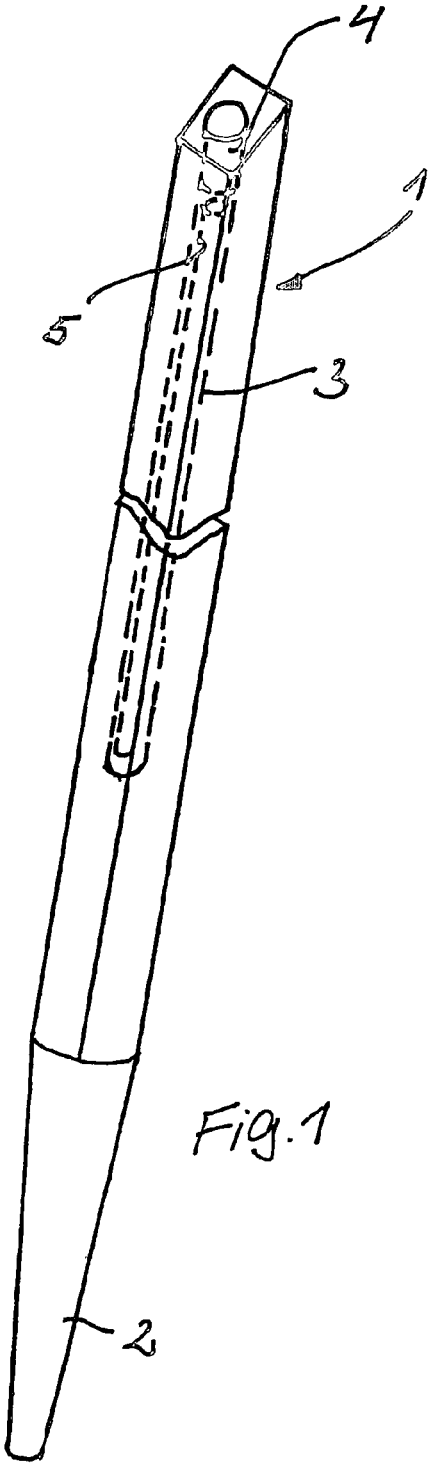
FIG. 1 is a perspective illustration of a chopstick according to the present invention.
Figure 2:
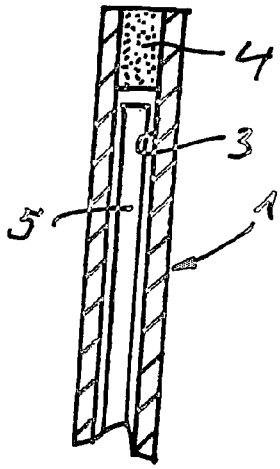
FIG. 2 illustrates a cross-section through the upper end of the chopstick illustrated in FIG. 1.

The present chopstick 1 illustrated in FIG. 1 has an inherently elongated shape. At one end the chopstick 1 preferably has a mouthpiece 2 that extends slightly conically. Elsewhere, the chopstick preferably has a rectangular cross-section. Starting from the front side turned away from the mouthpiece 2, a recess and/or a cavity 3, which preferably has the shape of a borehole, extends in the longitudinal direction into the chopsticks 1. The cavity 3 serves for holding an information carrier 5 that is preferably a note or slip of paper printed with a piece of information. In particular, the information carrier 5 is wound up into a small roll that is inserted into the borehole of the cavity 3 when the chopsticks 1 are being manufactured.

At its side turned away from the mouthpiece 2, the cavity 3 is closed preferably by a stopper 4, which is inserted into the end area of the cavity 3 and attached to it after the information carrier 5 is inserted into the cavity 3.

The chopsticks 1 expediently consist of wood and the stopper 4 also consists of wood, cork and the like. The stopper 4 is preferably glued into the end area of the cavity 11. However, it is also feasible to manufacture the chopsticks 1 and/or the stopper 4 from other materials, for example from plastic.

The cavity 3 preferably extends starting from the end lying opposite to the mouthpiece of the chopsticks 1 beyond half the length of the chopsticks 1. Consequently, breaking the chopsticks automatically provides an access to the information carrier 5 because chopsticks can usually be broken somewhat in the center.

At this point, it must be pointed out that even other objects can be placed in the cavity 3 in place of the information carrier 3. Thus, e.g., instead of the above-described note or slip of paper, even small figures or sweets (e.g., love pearls) or photographs can be accommodated into the cavity 3. What matters here is that this feature arouses the interest of people to eat using chopsticks 1 in order to obtain access to the objects hidden in the chopsticks 1 by breaking the chopsticks 1.

Figure 3:
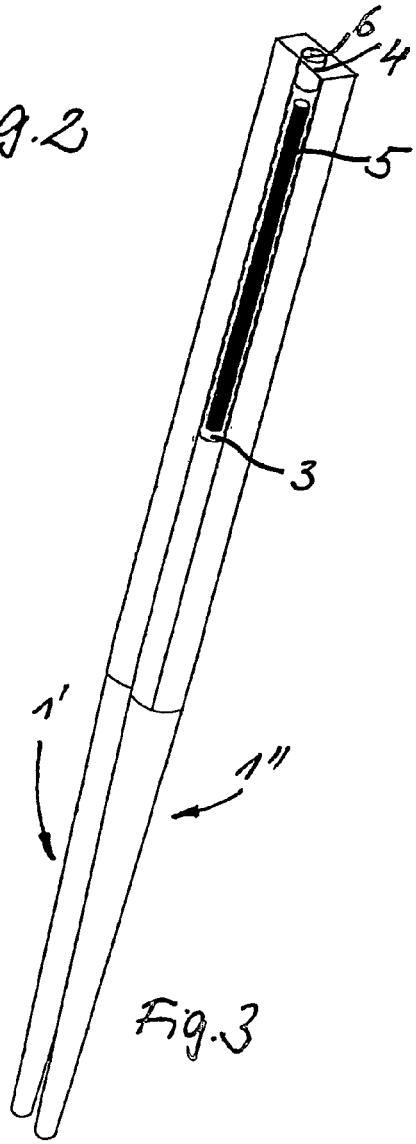
FIG. 3 illustrates another embodiment of the present invention.

In the following description, an embodiment of the present invention is explained on the basis of FIG. 3 in which two chopsticks 1', 1" are inherently connected to one another to form one unit. The details of FIG. 3 that have already been explained in connection with the other figures are also marked accordingly. As usual, preceding their use, the chopsticks 1', 1" can be separated from one another easily by breaking them apart in the connecting area 6. According to the present invention, the cavity 3 together with the object, preferably the information carrier 5, is located in the connecting area 6 so that the object and/or information carrier 5 is accessible even before the eating process simply by breaking the chopsticks 1', 1" apart.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. Chopstick comprising a cavity in a main body of said chopstick and an object placed in said cavity so as to be hidden from view, said object being an information carrier or a figure, a photograph or a sweet, said chopstick being connected to another chopstick in a connecting area, said cavity being arranged in said connecting area such that access to said object is gained when said chopsticks are separated from one another by breaking said connecting area prior to use, said cavity, starting from a side opposite a mouthpiece of the chopsticks, extending in a longitudinal direction into the chopsticks and the cavity being closed on the side opposite the mouthpiece by a fixed stopper.

2. Chopstick pursuant to claim 1, wherein the information carrier is a rolled up note or slip of paper.

3. Chopstick pursuant to claim 1, wherein said chopstick is made of wood.

4. Chopstick pursuant to claim 1, wherein said chopstick is made of plastic.

5. Chopstick pursuant to claim 1, wherein said chopstick is made of wood, cork or plastic.

6. Chopstick pursuant to claim 5, wherein the stopper is glued in an end area of the cavity.

7. Chopstick pursuant to claim 1, wherein the cavity extends beyond half a length of the chopstick.

8. Chopstick pursuant to claim 1, wherein the stopper is fixed with glue.

9. Chopstick comprising a main body and a solid mouthpiece, said main body having a blind bore extending longitudinally from an end opposite said mouthpiece into said chopstick main body to define a cavity that has an object placed therein, said object being an information carrier or a figure, a photograph or a sweet, said chopstick being connected to another chopstick in a breakable connecting area, said cavity being arranged in said connecting area such that access to said object is gained when said chopsticks are separated from one another by breaking said connecting area prior to use, said cavity being closed on the end opposite the mouthpiece by a fixed stopper so that said object is hidden from view and inaccessible without breaking the chopstick.

10. Chopstick pursuant to claim 9, wherein the information carrier is a rolled up note or slip of paper.

11. Chopstick pursuant to claim 9, wherein the stopper is fixed with glue.

12. Chopstick pursuant to claim 9, wherein the cavity extends beyond half a longitudinal length of the chopstick main body.

* * * * *